US007038382B2

(12) United States Patent
Hashikawa et al.

(10) Patent No.: US 7,038,382 B2
(45) Date of Patent: May 2, 2006

(54) PLASMA DISPLAY PANEL WITH OFFSET DISCHARGE ELECTRODES

(75) Inventors: Hirokazu Hashikawa, Yamanashi-ken (JP); Takahiro Togashi, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/831,269

(22) Filed: Apr. 26, 2004

(65) Prior Publication Data

US 2004/0222742 A1 Nov. 11, 2004

(30) Foreign Application Priority Data

May 8, 2003 (JP) ..... 2003-129831

(51) Int. Cl.
*H01J 17/49* (2006.01)

(52) U.S. Cl. ..... 313/582; 313/586

(58) Field of Classification Search ..... 313/582–587
See application file for complete search history.

(56) References Cited

U.S. PATENT DOCUMENTS 5,640,068 A * 6/1997 Amemiya ..... 313/582
6,137,226 A * 10/2000 Nagano ..... 313/582
6,342,874 B1 * 1/2002 Tokunaga et al. ..... 345/68
6,411,031 B1 * 6/2002 Ha et al. ..... 313/582
6,531,819 B1 * 3/2003 Nakahara et al. ..... 313/584
6,531,820 B1 * 3/2003 Lee et al. ..... 313/586
6,586,879 B1 * 7/2003 Shino et al. ..... 313/582
6,603,265 B1 * 8/2003 Ahn et al. ..... 313/586
6,608,447 B1 * 8/2003 Ahn ..... 315/169.1
6,624,591 B1 * 9/2003 Mori et al. ..... 315/169.3
6,734,626 B1 * 5/2004 Yoshioka et al. ..... 313/585
6,768,262 B1 * 7/2004 Ahn et al. ..... 313/582
6,777,873 B1 * 8/2004 Hashikawa ..... 313/582

FOREIGN PATENT DOCUMENTS

JP 2001-283735 10/2001

* cited by examiner

*Primary Examiner*—Joseph Williams
*Assistant Examiner*—Dalei Dong
(74) *Attorney, Agent, or Firm*—McGinn IP Law Group, PLLC

(57) ABSTRACT

First electrodes each having a first bus electrode extending in the row direction are arranged regularly in the column direction on the rear-facing face of a front glass substrate, and covered with a first dielectric layer. On the rear-facing face of the first dielectric layer, second electrodes each having a second electrode body extending in the column direction are arranged regularly in the row direction and covered with a second dielectric layer. A first transparent electrode projecting from the first bus electrode and a second transparent electrode projecting from the second electrode body face each other at a required interval when viewed from the front glass substrate. A recess is formed in a portion of the second dielectric layer covering the first transparent electrode and facing toward the discharge space.

18 Claims, 6 Drawing Sheets

SECTION V-V

SECTION W-W (FIRST EMBODIMENT)

SECTION V1-V1

SECTION V2-V2

SECTION V3-V3

SECTION W1-W1

SECTION W2-W2

SECTION W3-W3

(SECOND EMBODIMENT)

PLASMA DISPLAY PANEL WITH OFFSET DISCHARGE ELECTRODES

BACKGROUND OF THE INVENTION

1. Field of the Invention

This invention relates to a panel structure for plasma display panels.

The present application claims priority from Japanese Applications No. 2003-129831, the disclosures of which are incorporated herein by reference.

2. Description of the Related Art

Surface-discharge-type AC plasma display panels (hereinafter referred to as "PDP") have recently gained the spotlight as types of large-sized slim color display apparatuses and are becoming increasingly common in homes and the like.

FIG. 1 to FIG. 4 illustrate the structure of a conventional two-electrode surface-discharge-type AC PDP.

FIG. 1 is a perspective view partially showing the panel structure of the conventional PDP. FIG. 2 is a front view of the display surface of the PDP. FIG. 3 is a sectional view taken along the V—V line in FIG. 2. FIG. 4 is a sectional view taken along the W—W line in FIG. 2.

In FIGS. 1 to 4, second electrodes Y each extending in the column direction (the vertical direction in FIG. 2) are arranged regularly at required intervals in the row direction (the right-left direction in FIG. 2) on the rear-facing face of a front glass substrate 1. The second electrodes Y are covered with a first dielectric layer 2 formed on the rear-facing face of the front glass substrate 1.

First electrodes X each extending in the row direction are arranged regularly at required intervals in the column direction on the rear-facing face of the first dielectric layer 2, and covered with a second dielectric layer 3 formed on the rear-facing face of the first dielectric layer 2.

The first electrode X is composed of a first electrode body Xa formed of a strip-shaped metal film extending in the row direction, and first electrode projections Xb formed of a transparent conductive film made of ITO or the like. Each of the first electrode projections Xb extends in the downward direction in FIG. 2 from the mid-position in each section of the first electrode body Xa between the adjacent two second electrodes Y.

The second electrode Y is composed of a second electrode body Ya formed of a strip-shaped metal film extending in the column direction, and second electrode projections Yb formed of a transparent conductive film made of ITO or the like. Each of the second electrode projections Yb extends in the row direction from approximately the mid-position in each section of the second electrode body Ya between the adjacent two first electrodes X, to a position opposite to the first electrode projection Xb when viewed from the front glass substrate 1.

An MgO-made protective layer 4 is formed on the rear-facing face of the second dielectric layer 3.

The front glass substrate 1 is opposite and parallel to a back glass substrate 5 with a discharge space S in between. Strip-shaped partition walls 6 are formed on the inner face of the back glass substrate 5 facing toward the front glass substrate 1. Each of the partition walls 6 extends in the column direction in a position opposite the second electrode body Ya of the second electrode Y.

Phosphor layers 7 are formed individually between the two partition walls 6 on the back glass substrate 5, in other words, in a position opposite the first electrode projections Xb of the first electrodes X and the second electrode projections Yb of the second projection Y when viewed from the front glass substrate 1, in such a way as to cover the face of the back glass substrate 5 and side faces of the partition walls 6.

The colors used for the phosphor layers 7 are the three primary colors red (R), green (G) and blue (B), which are arranged in this order in the row direction.

Inside the discharge space S, discharge cells C are formed in each position opposite the opposed and paired first and second electrode projections Xb and Yb of the first and second electrodes X and Y when viewed from the front glass substrate 1.

The discharge space S is filled with a discharge gas.

In the aforementioned two-electrode-structured PDP, in a reset period, a reset discharge is produced, simultaneously in all discharge cells C, between the first electrode projection Xb of the first electrode X and the second electrode projection Yb of the second electrode Y, to erase the wall charge on the first dielectric layer 2 and the second dielectric layer 3.

Then, in the subsequent addressing period, a scan pulse is sequentially applied to the first electrode X, and a data pulse generated according to the image signal is applied to the second electrode Y. Thereupon, selectively, an addressing discharge is produced between the opposed and paired first and second electrode projections Xb and Yb.

As a result of this addressing discharge, the discharge cells (lighted cells) C having a wall charge generated through the discharge, and the discharge cells (non-lighted cells) C having no wall charge generated are distributed over the panel surface of the PDP in accordance with the image to be generated.

After that, in the subsequent discharge-sustaining emission period, a discharge-sustaining pulse is applied alternately to the first electrode X and the second electrode Y. With every application of the discharge-sustaining pulse, a sustain discharge d (see FIG. 3) is produced between the first and second electrode projections Xb and Yb opposite to each other in each lighted cell.

This sustain discharge d effects the generation of ultraviolet light from the discharge gas sealed in the discharge space S. The ultraviolet light excites the red (R)-, green (G)- and blue (B)-colored phosphor layers 7 facing the lighted cells to allow the phosphor layers 7 to emit visible light for the generation of the image according to the image signal on the panel surface of the PDP.

The conventional panel structure for the PDP as described above is described in Japanese Patent Laid-open Application No. 2001-283735.

This conventional two-electrode-structure PDP has the first electrode X and the second electrode Y formed respectively in the different dielectric layers, namely in the first dielectric layer 2 and the second dielectric layer 3, as is seen clearly from FIG. 3, so as to be positioned individually in different planes from each other in the thickness direction of the PDP. Hence, the thickness of the dielectric layer interposed between the first electrode X and the discharge space at the discharge cell C is different from, i.e. thinner than, the thickness of the dielectric layer interposed between the second electrode Y and the discharge space in the discharge cell C.

For this reason, the first electrode X and the second electrode Y differ in the electric field created in the discharge space at the discharge cell C. As a result, there is a likelihood of the problem of a discharge being produced only in one direction.

Further, a difference is likely to occur between the drive voltages applied to the first electrode X and the second electrode Y, making the discharge characteristics unstable.

SUMMARY OF THE INVENTION

The present invention is essentially designed to solve the problems associated with the conventional two-electrode structure plasma display panel as described hitherto.

It therefore is an object of the present invention to provide a plasma display panel having a two-electrode structure and capable of producing a stable sustain discharge and bringing stability to the discharge characteristics.

To attain this object, in the plasma display panel according to the present invention, a front substrate and a back substrate face each other with a discharge space in between. A dielectric layer is formed on the face of the front substrate facing toward the back substrate. First electrodes are regularly arranged in plurality in the column direction, and each have a first electrode body extending in the row direction. Second electrodes are regularly arranged in plurality in the row direction, and each have a second electrode body extending in the column direction. The first electrodes and the second electrodes are formed independently in the dielectric layer in a different plane from each other in the thickness direction of the front substrate. First electrode projections project from the first electrode body of the first electrode, and second electrode projections project from the second electrode body of the second electrode, such that each of the first electrode projections faces the corresponding second electrode projection at a required interval when viewed from the front substrate. Then, recesses are formed individually in portions of the dielectric layer facing the discharge space and each covering at least the electrode projection of either the first electrode or the second electrode located close to the front substrate in the thickness direction of the front substrate.

In this plasma display panel, in a reset period, a reset discharge is simultaneously produced between all of the first electrode projections of the first electrodes and all the second electrode projections of the second electrodes, to erase all the wall charge on the dielectric layer covering the first electrodes and the second electrodes (or alternatively to entirely generate wall charge on the dielectric layer).

Then, in the subsequent addressing period, a scan pulse is sequentially applied to the first electrode, and a data pulse generated according to the image signal is applied to the second electrode. Thereupon, an addressing discharge is caused selectively between the paired first and second electrode projections.

A wall charge is created on (or alternatively the wall charge accumulated are entirely erased from) portions of the first dielectric layer subjected to the addressing discharge selectively produced. As a result, discharge cells (lighted cells) having the wall charge generated on the dielectric layer and discharge cells (non-lighted cells) having no wall charge generated are distributed over the panel surface of the plasma display panel in accordance with the image to be generated.

After that, in the subsequent discharge-sustaining emission period, a discharge-sustaining pulse is alternately applied to the first electrode and the second electrode. With every application of the discharge-sustaining pulse, a sustain discharge is caused between the paired first and second electrode projections in each lighted cell.

In this discharge-sustaining emission period, discharge-sustaining pulses of the same voltage are applied to the first electrode and the second electrode.

In connection with this, the recesses are formed respectively in the portions of the dielectric layer facing the discharge space and covering at least the electrode projections of either the first electrode or the second electrode which is located close to the front substrate in the thickness direction of the front substrate. This formation of the recesses in the dielectric layer decreases the difference between the distance from the first electrode projection to the discharge space in the discharge cell and the distance from the second electrode projection to the discharge space in the discharge cell.

For this reason, even when the discharge-sustaining pulses applied to the first electrode and the second electrode are identical in voltage, the electric fields created in the discharge space at the discharge cell become approximately equal in the first electrode and the second electrode. This uniformity in electric fields eliminates the likelihood of giving rise to the conventional problem of a sustain discharge being produced only in one direction when discharge sustaining pulses of the same voltage are applied to the paired electrodes.

Further, the present invention eliminates the need to change the voltage for the individual application of the discharge-sustaining pulses to the first electrode and the second electrode. This elimination makes it possible to prevent the discharge characteristics from becoming unstable because of the occurrence of a difference between the drive voltages.

These and other objects and features of the present invention will become more apparent from the following detailed description with reference to the accompanying drawings.

DETAILED DESCRIPTION OF THE PREFERRED EMBODIMENTS

Preferred embodiments of the present invention will be described below in detail with reference to the accompanying drawings.

Figure 1:
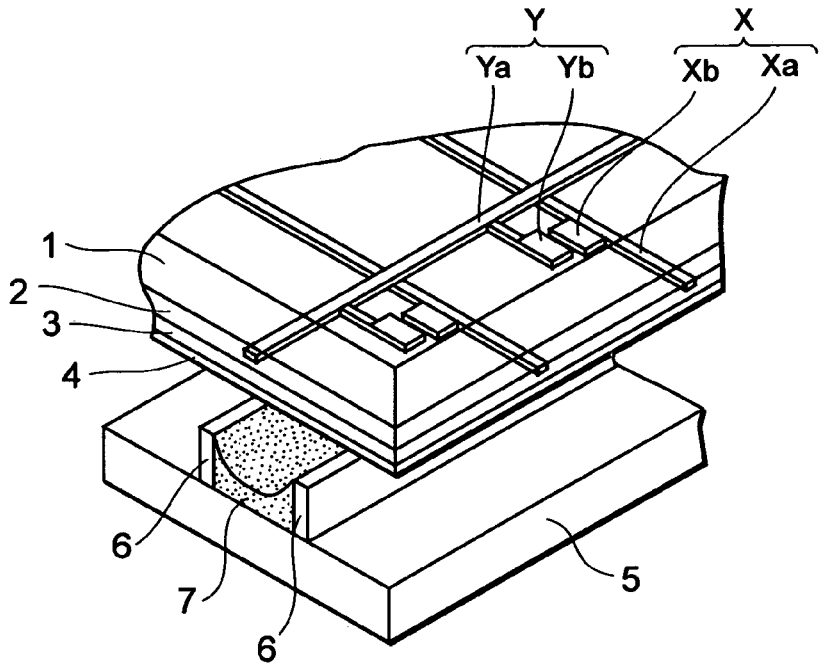
Fig.1 PRIOR ART
FIG. 1 is a perspective view illustrating a conventional example.
Figure 2:
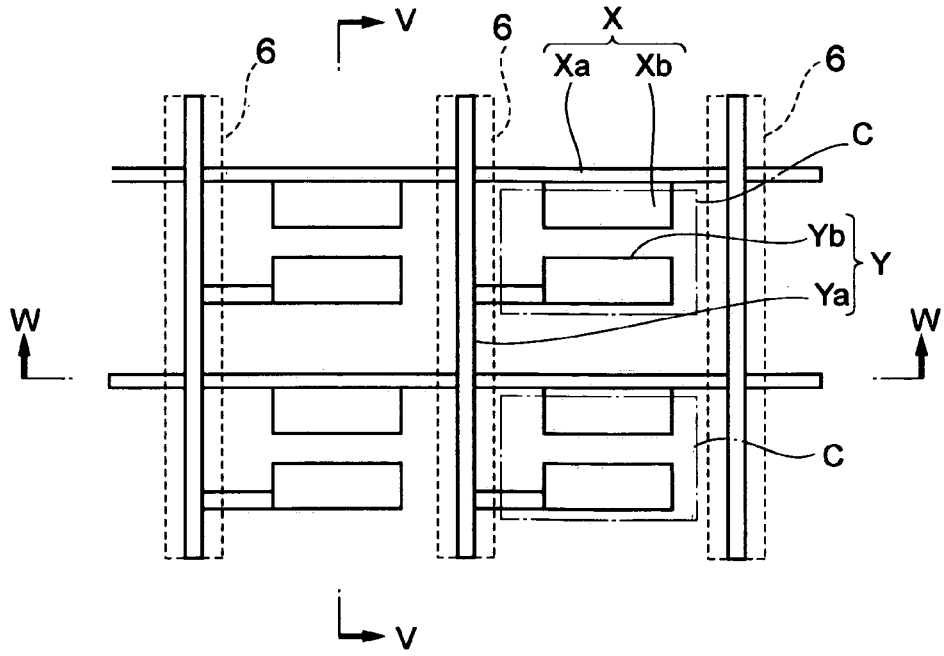
Fig.2 PRIOR ART
FIG. 2 is a front view of the conventional example.
Figure 3:
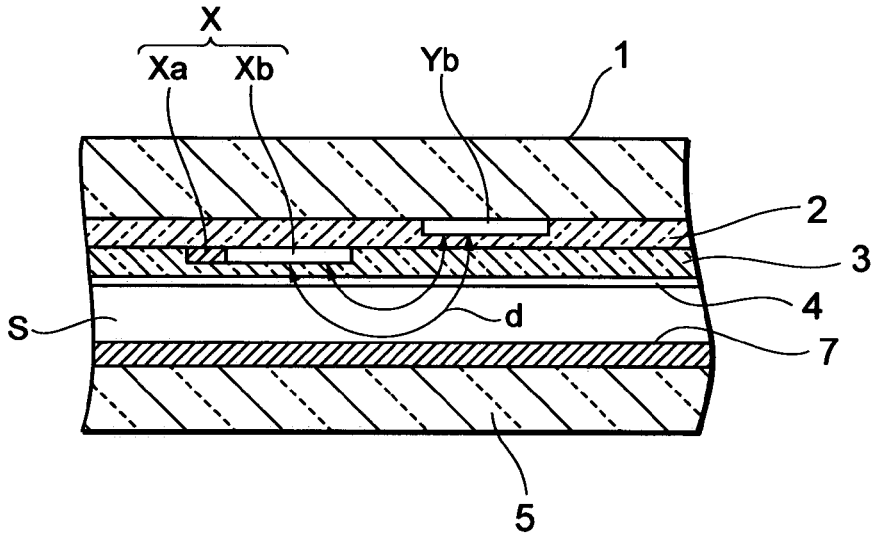
Fig.3 PRIOR ART
FIG. 3 is a sectional view taken along the V—V line in FIG. 2.
Figure 4:
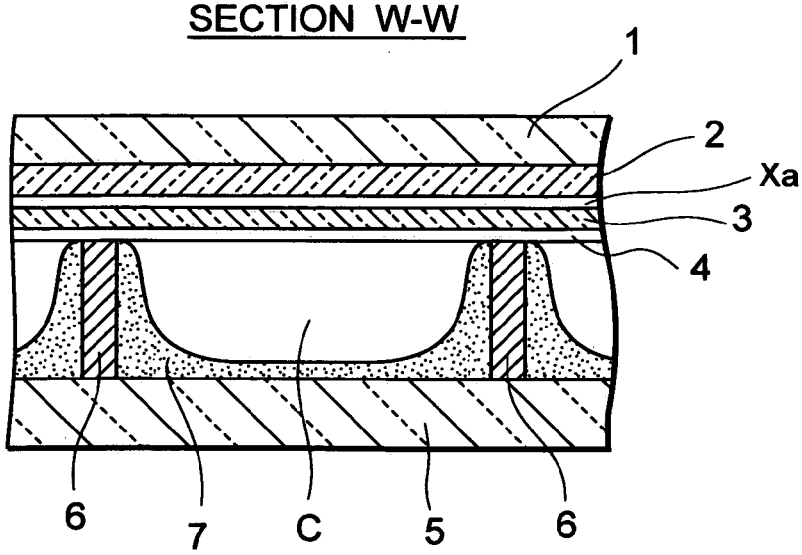
Fig.4 PRIOR ART
FIG. 4 is a sectional view taken along the W—W line in FIG. 2.
Figure 5:
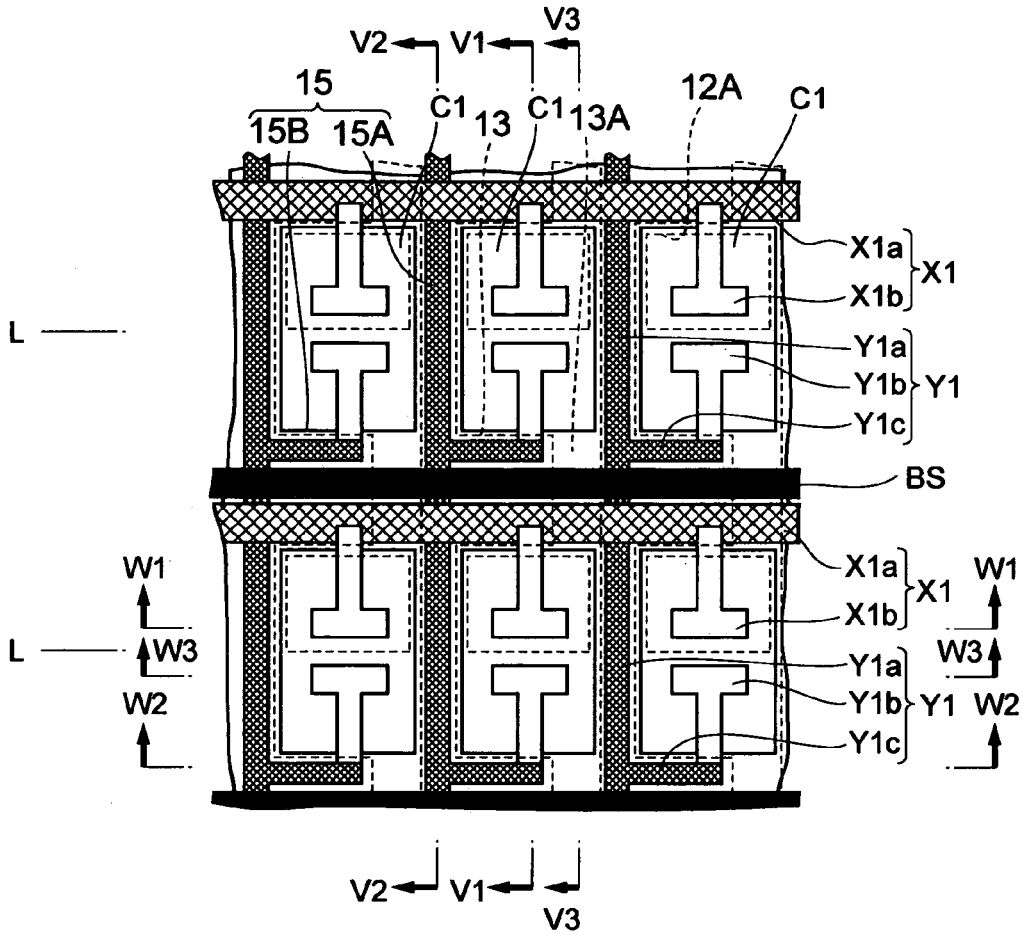
FIG. 5 is a schematic front view illustrating a first embodiment according to the present invention.

FIG. 5 to FIG. 11 illustrate a first embodiment of the two-electrode-structure plasma display panel (hereinafter referred to as "PDP") according to the present invention: FIG. 5 is a schematic front view of the PDP in the first embodiment, and FIGS. 6 to 11 are sectional views respectively taken along the V1—V1 line, the V2—V2 line, the V3—V3 line, the W1—W1 line, the W2—W2 line and the W3—W3 line as shown in FIG. 5.

In FIGS. 5 to 11, on the rear-facing face of a front glass substrate 10, first electrodes X1 each extending in the row direction (the right-left direction in FIG. 5) are arranged regularly at required intervals in the column direction (the vertical direction in FIG. 5).

The first electrode X1 is composed of a strip-shaped first bus electrode X1*a* formed of a black- or dark-colored metal film extending in the row direction, and T-shaped first transparent electrodes X1*b* formed of a transparent conductive film made of ITO or the like and spaced uniformly along the first bus electrodes X1*a*. Each of the first transparent electrodes X1*b* is connected to the first bus electrode X1*a* at the narrowed proximal end thereof (corresponding to the foot of the "T") and extends therefrom in the downward direction in FIG. 5.

The front glass substrate 10 further has black-or dark-colored light absorption layers (light-shield layers) BS formed on the rear-facing face thereof. Each of the light absorption layers BS extends in the row direction in parallel with the side edge of the first bus electrode X1*a* opposite to the side edge from which the first transparent electrodes X1*b* project.

The first electrodes X1 and the light absorption layers (light-shield layers) BS are covered with a first dielectric layer 11 formed on the rear-facing face of the front glass substrate 10.

On the rear-facing face of the first dielectric layer 2, second electrodes Y1 each extending in the column direction are arranged regularly at required intervals in the row direction.

Each of the second electrodes Y1 is composed of: a strip-shaped second electrode body Y1*a* formed of a black- or dark-colored metal film; T-shaped second transparent electrodes Y1*b* formed of a transparent conductive film made of ITO or the like; and strip-shaped electrode coupling portions Y1*c* formed of a black- or dark-colored metal film extending between the second electrode body Y1*a* and the second transparent electrode Y1*b*. The second electrode body Y1*a* extends in the column direction opposite to a strip passing through the mid-position between the two adjacent first transparent electrodes X1*b* spaced uniformly along the first bus electrode X1*a* of each row of first electrodes X1. Each of the second transparent electrodes Y1*b* is positioned such that the widened top thereof (corresponding to the head of the "T") is situated opposite and parallel to the widened top of the "T" shape of the first transparent electrode X1*b* of the first electrode X1 at a required interval when viewed from the front glass substrate 10. Each of the electrode coupling portions Y1*c* extends from the second electrode body Y1*a* in the row direction to connect the second electrode body Y1*a* to the narrowed proximal end (corresponding to the foot of the "T") of the second transparent electrode Y1*b*.

The electrode coupling portion Y1*c* of the second electrode Y1 extends in parallel with the light absorption layer (light-shield layer) BS on the opposite side of this light absorption layer (light-shield layer) BS from the first bus electrode X1*a* when viewed from the front glass substrate 10.

The second electrodes Y1 are covered with a second dielectric layer 12 formed on the rear-facing face of the first dielectric layer 11.

The second dielectric layer 12 has approximately the same thickness as that of the first dielectric layer 11.

The second dielectric layer 12 has quadrangular recesses 12A each formed opposite to the first transparent electrode X1*b* of the first electrode X1 when viewed from the front glass substrate 10.

Additional dielectric layers 13 are formed so as to project from the rear-facing face of the second dielectric layer 12 in a direction opposite to the front glass substrate 10. Each of the additional dielectric layers 13 is opposite: the second electrode body Y1*a* and the electrode coupling portions Y1*c* of the second electrode Y1; portions of the first bus electrodes X1*a* each opposite to the electrode coupling portion Y1*c* when viewed from the front glass substrate 10; and portions of the light absorption layers (light-shield layer) BS each sandwiched between the electrode coupling portion Y1*c* and the first bus electrode X1*a* when viewed from the front glass substrate 10.

Figure 8:
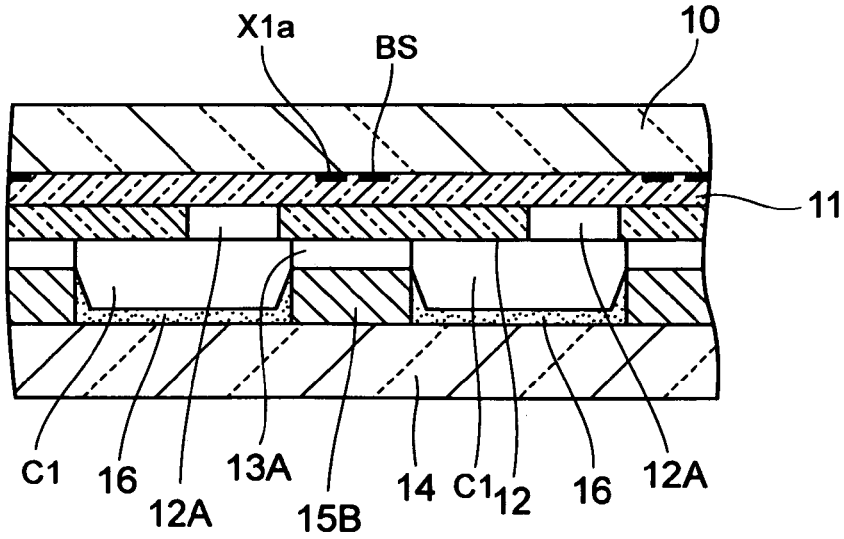
FIG. 8 is a sectional view taken along the V3—V3 line in FIG. 5.

As shown in FIGS. 5 and 8, the additional dielectric layer 13 is not formed opposite the area between the leading end of the electrode coupling portion Y1*c* of the second electrode Y1 (the right-hand end in FIG. 5) and the second electrode body Y1*a* of another second electrode Y1 adjacent thereto, so that a groove 13A extending in the column direction is formed in the corresponding position.

The faces of the additional dielectric layer 13, the second dielectric layer 12 and the first dielectric layer 11 in each recess 12A are covered with an MgO-made protective layer (not shown).

The front glass substrate 10 structured as described above is placed opposite and parallel to a back glass substrate 14 at a required distance therefrom.

On the face (i.e. inner face) of the back glass substrate 14 facing toward the front glass substrate 10, a partition wall 15 is provided for partitioning the space thus defined between the front glass substrate 10 and the back glass substrate 14.

The partition wall 15 is formed in an approximately grid shape by being constituted of: vertical walls 15A each extending in a strip shape in the column direction and opposite the second electrode body Y1*a* of the second electrode Y1; and lateral walls 15B each extending in a strip shape in the row direction. Each of the lateral walls 15B is opposite: the first bus electrode X1*a* of the first electrode X1; a strip extending in the row direction so as to pass through the electrode coupling portions Y1*c* of the second electrodes Y1; and the light absorption layer (light-shield layer) BS.

The partition wall 15 partitions the discharge space between the front glass substrate 10 and the back glass substrate 14 into quadrangular areas each opposite to the paired first and second transparent electrodes X1*b* and Y1*b*, to form individual discharge cells C1.

Figure 9:
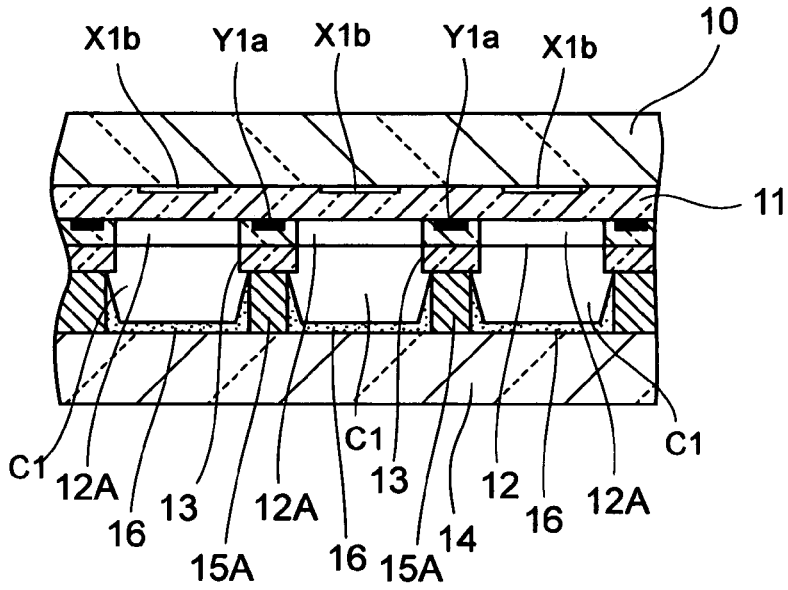
FIG. 9 is a sectional view taken along the W1—W1 line in FIG. 5.
Figure 10:
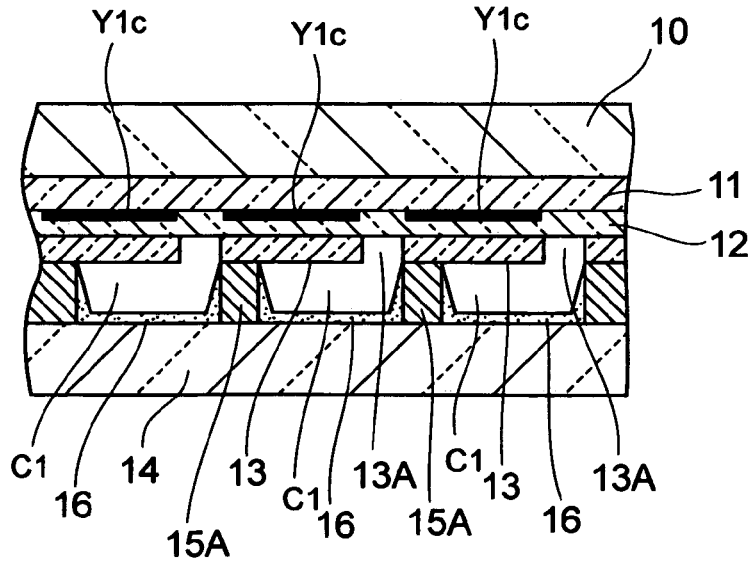
FIG. 10 is a sectional view taken along the W2—W2 line in FIG. 5.
Figure 11:
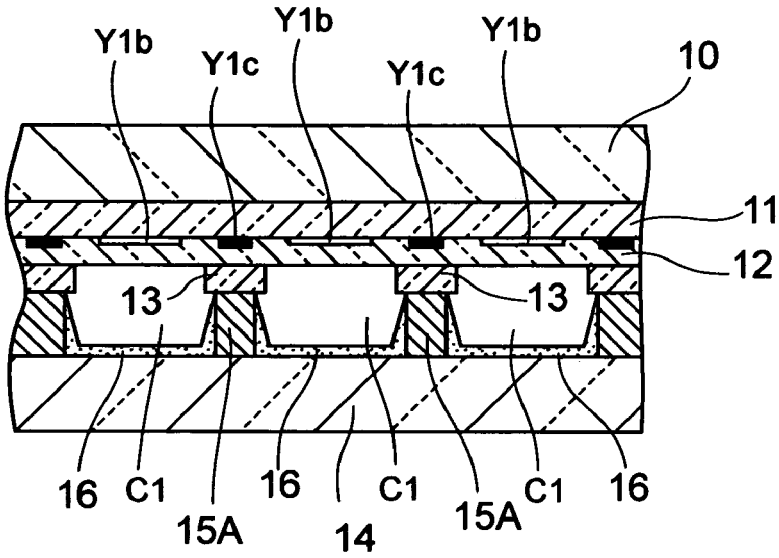
FIG. 11 is a sectional view taken along the W3—W3 line in FIG. 5.

The face (the front-facing face) of the vertical wall 15A of the partition wall 15 facing toward the front glass substrate 10 is in contact with the protective layer covering the additional dielectric layer 13 to block one discharge cell C1 from another discharge cell C1 adjacent thereto in the column direction (see FIGS. 9 and 11).

Figure 6:
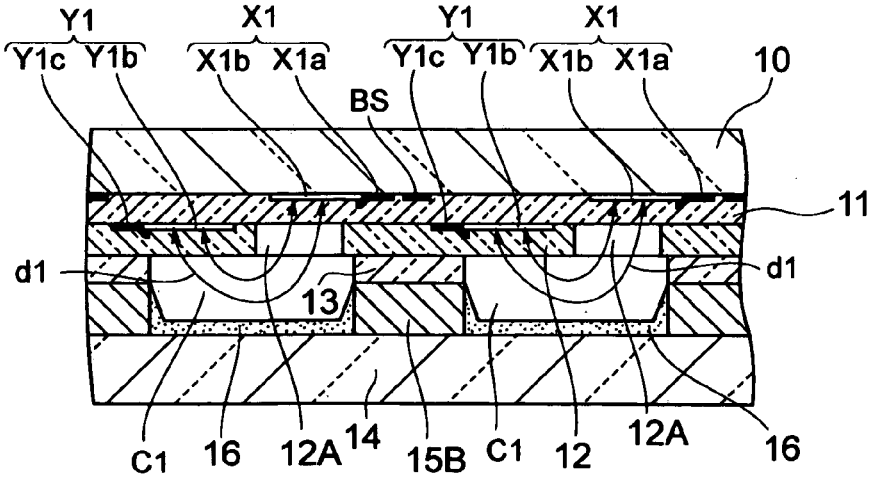
FIG. 6 is a sectional view taken along the V1—V1 line in FIG. 5.
Figure 7:
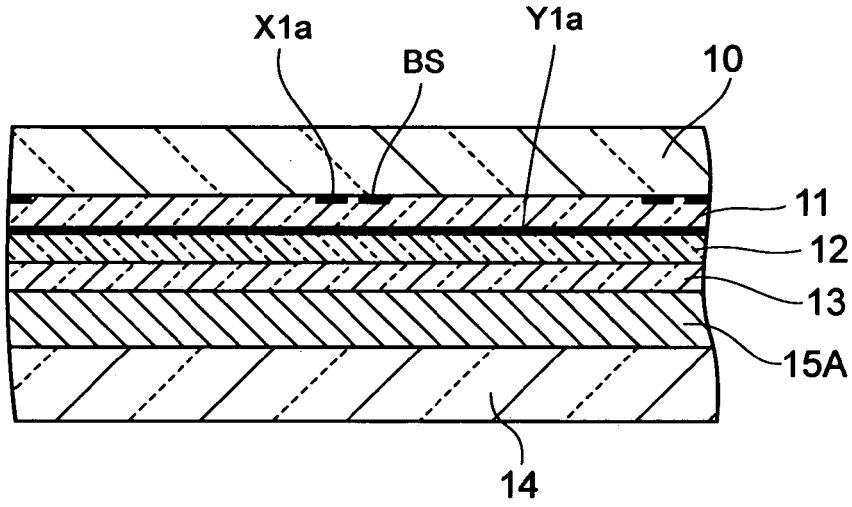
FIG. 7 is a sectional view taken along the V2—V2 line in FIG. 5.

As shown in FIG. 6, apart of the lateral wall 15B of the partition wall 15 is in contact with the protective layer covering the additional dielectric layer 13. However, because of the groove 13A in the additional dielectric layer 13, a clearance is created between the front-facing face of the lateral wall 15B and the protective layer covering the second dielectric layer 12 so that the adjacent discharge cells C1 in the column direction communicate by means of the groove 13A.

In each discharge cell C1, a phosphor layer 16 covers five faces: the face of the back glass substrate 14 and the side faces of the vertical walls 15A and the lateral walls 15B of the partition wall 15.

The three primary colors red (R), green (G) and blue (B) are applied to the phosphor layers 16 so that the red-, green- and blue-colored phosphor layers 16 are arranged in this order in the row direction.

The discharge space is filled with a discharge gas including Ne and ten percent or more of Xe.

A row of discharge cells C1 arranged in the row direction forms a display line L.

In the aforementioned two-electrode-structured PDP, in a reset period, a reset discharge is produced, simultaneously in all discharge cells C1, between the first transparent electrode X1*b* of the first electrode X1 and the second transparent electrode Y1*b* of the second electrode Y1, to entirely erase the wall charge on the first dielectric layer 11 and the second dielectric layer 12 (or alternatively to entirely generate a wall charge on the first dielectric layer 11 and the second dielectric layer 12).

Then, in the subsequent addressing period, a scan pulse is sequentially applied to the first electrode X1, and a data pulse generated according to the image signal is applied to the second electrode Y1. Thereupon, an addressing discharge is selectively produced between the paired first and second transparent electrodes X1*b* and Y1*b*.

In the selected discharge cells C1 subjected to the addressing discharge, a wall charge is created on (or alternatively the wall charge accumulated is entirely erased from) the first dielectric layer 11 and the second dielectric layer 12 by the addressing discharge. As a result, the discharge cells (lighted cells) C1 having a wall charge generated on the first dielectric layer 11 and the second dielectric layer 12, and the discharge cells (non-lighted cells) C1 having no wall charge generated are distributed over the panel surface of the PDP in accordance with the image to be generated, After that, in the subsequent discharge-sustaining emission period, a discharge-sustaining pulse is alternately applied to the first electrode X1 and the second electrode Y1. With every application of the discharge-sustaining pulse, a sustain discharge d1 (see FIG. 6) is produced between the paired first and second transparent electrodes X1*b* and Y1*b* in each lighted cell.

This sustain discharge d1 effects the generation of ultraviolet light from the Xe in the discharge gas sealed in the discharge space. The ultraviolet light excites the red (R)-, green (G)- and blue (B)-colored phosphor layers 16 facing the lighted cells to allow the phosphor layers 16 to emit visible light for the generation of the image according to the image signal on the panel surface of the PDP.

In this discharge-sustaining emission period, discharge-sustaining pulses of the same voltage are applied to the first electrode X1 and the second electrode Y1.

In connection with this, because of the formation of the recess 12A, only the first dielectric layer 11 having approximately the same thickness as that of the second dielectric layer 12 is interposed between the first transparent electrode X1*b* and the discharge space at the discharge cell C1 in the PDP of the first embodiment. Hence, the distance from the first transparent electrode X1*b* to the discharge space in the discharge cell C1 is approximately equal to the distance from the second transparent electrode Y1*b* to the discharge space in the discharge cell C1.

For this reason, even when the discharge-sustaining pulses applied to the first electrode X1 and the second electrode Y1 are identical in voltage, the electric fields created in the discharge space of the discharge cell C1 become approximately equal at the first electrode X1 and the second electrode Y1. This uniformity in the electric fields eliminates the likelihood of giving rise to the conventional problem of a sustain discharge being produced only in one direction when discharge sustaining pulses of the same voltage are applied to the paired electrodes.

Further, the present invention eliminates the need to change the voltage for individual application of the discharge-sustaining pulses to the first electrode X1 and the second electrode Y1. This elimination makes it possible to prevent the discharge characteristics from becoming unstable because of the occurrence of a difference between the drive voltages.

The PDP of the first embodiment has the vertical wall 15A of the partition wall 15 adjoining the protective layer covering the additional dielectric layer 13 to block off the discharge cells C1 adjacent to each other in the row direction from each other. Because of this block, the addressing discharge and the sustaining discharge are prevented from spreading beyond one discharge cell C1 to another discharge cell C1 adjacent thereto in the row direction, leading to the prevention of the occurrence of a false addressing discharge and a false sustaining discharge.

Further, part of the lateral wall 15B of the partition wall 15 is in contact with the protective layer covering the additional dielectric layer 13 to partially block off one discharge cell C1 from another discharge cell C1 adjacent thereto in the column direction. Thus, the addressing discharge and the sustaining discharge are also prevented from spreading beyond one discharge cell C1 to another discharge cell C1 adjacent thereto in the column direction, leading to the prevention of the occurrence of a false addressing discharge and a false sustaining discharge. Further, the formation of the groove 13A allows for communication between the adjacent discharge cells C1 in the column direction so that the priming particles generated by the discharge flows through the groove 13A into adjacent discharge cells C1, resulting in a priming effect which allows for induction of the discharge into the adjacent discharge cells C1.

With the PDP in the first embodiment, because the partition wall 15 is formed in an approximate grid shape and the phosphor layer 16 is formed also on the side faces of the vertical walls 15A and the lateral walls 15B of the partition wall 15, as compared with a conventional PDP, the light-emission area of the phosphor layer 16 in each discharge cell C1 is enlarged, to significantly increase the luminous efficiency.

Figure 12:
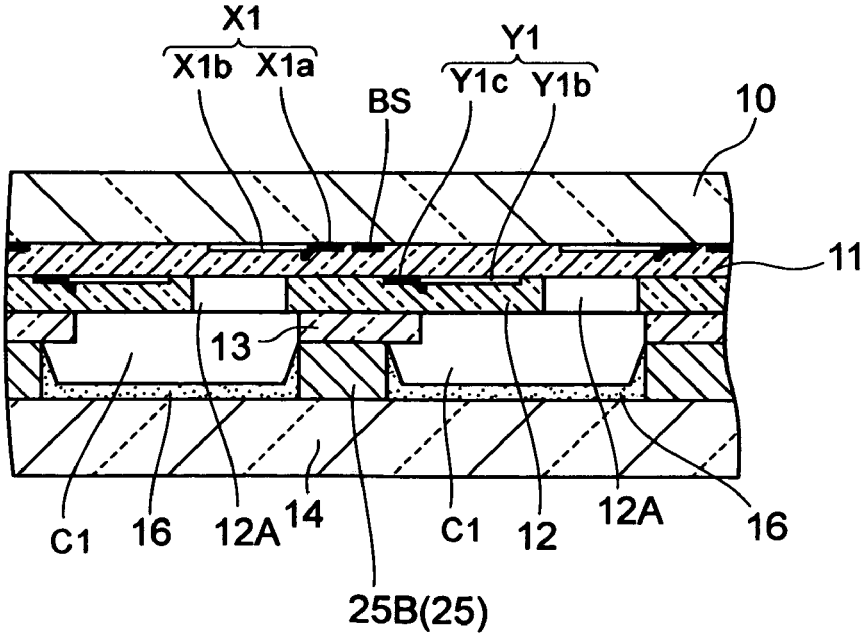
FIG. 12 is a sectional view illustrating a second embodiment according to the present invention.

FIG. 12 illustrates a second embodiment of the PDP according to the present invention.

FIG. 12 is a sectional side view of the PDP in the second embodiment through the same section as in the case of FIG. 6.

The lateral walls 15B of the partition wall 15 of the first embodiment have a sufficient width to be opposite to the first bus electrode X1*a* of the first electrode X1, the electrode coupling portion Y1*c* of the second electrode Y1 and the light absorption layer (light-shield layer) BS. However, lateral walls 25B of a partition wall 25 of the PDP in the second embodiment have only a sufficient width to be opposite to the first bus electrode X1*a* of the first electrode X1 and the light absorption layer (light-shield layer) BS. That is, the width of the lateral wall 25B is less than that in the case of the first embodiment.

The structure of the other components is approximately the same as that of the PDP in the first embodiment, and the same reference numerals are designated.

As compared with the PDP described in the first embodiment, the PDP of the second embodiment has a reduction in the inter electrode capacitance created between the first bus electrode X1*a* and the electrode coupling portion Y1*c* of the second electrode Y1 which are located back to back in between the adjacent display lines when viewed from the front glass substrate 10.

In the first and second embodiments, the position of the first electrode X1 is closer to the front glass substrate 10 than the position of the second electrode Y1 is, and recesses 12A are each formed in a portion of the second dielectric layer 12 opposite to the first transparent electrode X1*b*. However, the position of the second electrode Y1 can be closer to the front glass substrate 10 than the position of the first electrode X1 is, and the second electrode Y1 can be covered with the first dielectric layer 11 and the first electrode X1 can be covered with the second dielectric layer 12. In this case, the recesses 12A are each formed in a portion of the second dielectric layer 12 opposite the second transparent electrode Y1*b* of the second electrode Y1.

The first and second embodiments have described a PDP based on the superior idea that: a front substrate and a back substrate face each other with a discharge space in between; a dielectric layer is formed on the face of the front substrate facing toward the back substrate; first electrodes are regularly arranged in plurality in the column direction and each have a first electrode body extending in the row direction; second electrodes are regularly arranged in plurality in the row direction and each have a second electrode body extending in the column direction; the first electrodes and the second electrodes are independently formed in the dielectric layer in a different plane from each other in the thickness direction of the front substrate; each of first electrode projections projecting from the first electrode body of the first electrode and each of second electrode projections projecting from the second electrode body of the second electrode face each other at a required interval when viewed from the front substrate; and recesses are formed individually in portions of the dielectric layer facing the discharge space and covering at least the electrode projections of either the first electrodes or the second electrodes located close to the front substrate in the thickness direction of the front substrate.

In the PDP structure based on this superior idea, in a reset period, a reset discharge is simultaneously produced between all the first electrode projections of the first electrodes and all the second electrode projections of the second electrodes, to entirely erase the wall charge on the dielectric layer covering the first electrodes and the second electrodes (or alternatively to entirely generate a wall charge on the dielectric layer).

Then, in the subsequent addressing period, a scan pulse is sequentially applied to the first electrodes, and a data pulse generated according to the image signal is applied to the second electrodes. Thereupon, an addressing discharge is selectively caused between the paired first and second electrode projections.

A wall charge is created on (or alternatively the wall charge accumulated is entirely erased from) portions of the dielectric layer subjected to the addressing discharge selectively produced. As a result, discharge cells (lighted cells) having a wall charge generated on the dielectric layer and discharge cells (non-lighted cells) having no wall charge generated are distributed over the panel surface of the PDP in accordance with the image to be generated.

After that, in the subsequent discharge-sustaining emission period, a discharge-sustaining pulse is alternately applied to the first electrode and the second electrode. With every application of the discharge-sustaining pulse, a sustain discharge is caused between the paired first and second electrode projections in each lighted cell.

In this discharge-sustaining emission period, the discharge-sustaining pulses of the same voltage are applied to the first electrode and the second electrode.

In connection with this, recesses are formed respectively in the portions of the dielectric layer facing the discharge space and covering at least the electrode projections of either the first electrode or the second electrode which is located close to the front substrate in the thickness direction of the front substrate, thereby decreasing the difference between the distance from the first electrode projection to the discharge space in the discharge cell and the distance from the second electrode projection to the discharge space in the discharge cell.

For this reason, even when the discharge-sustaining pulses applied to the first electrode and the second electrode are identical in voltage, the electric fields created in the discharge space at the discharge cell become approximately equal at the first electrode and the second electrode. This uniformity in electric fields eliminates the likelihood of giving rise to the conventional problem of a sustain discharge only being produced in one direction when discharge sustaining pulses of the same voltage are applied to the paired electrodes.

Further, the present invention eliminates the need to change the voltage for individual application of the discharge-sustaining pulses to the first electrode and the second electrode. This elimination makes it possible to prevent the discharge characteristics from becoming unstable because of the occurrence of a difference between the drive voltages.

The terms and description used herein are set forth by way of illustration only and are not meant as limitations. Those skilled in the art will recognize that numerous variations are possible within the spirit and scope of the invention as defined in the following claims.

What is claimed is:

1. A two-electrode-structure plasma display panel, comprising:

a front substrate and a back substrate facing each other with a discharge space in between;

a dielectric layer formed on a face of the front substrate facing toward the back substrate;

a plurality of first electrodes arranged regularly in a column direction in the dielectric layer, and each having a first electrode body extending in a row direction and first electrode projections projecting from the first electrode body;

a plurality of second electrodes arranged regularly in the iow direction in the dielectric layer in a different plane from that in which the plurality of first electrodes are formed, in a thickness direction of the front substrate, and each having a second electrode body extending in the column direction and second electrode projections projecting from the second electrode body, each of the second electrode projections facing the first electrode projection at a required interval when viewed from the front substrate; and recesses formed individually in portions of the dielectric layer facing the discharge space and covering at least the electrode projections of one of a first electrode and a second electrode of the first and second electrodes located close to the front substrate in the thickness direction of the front substrate.

2. A two-electrode-structure plasma display panel according to claim 1, wherein the dielectric layer interposed between the discharge space and the electrode projections of one of the first electrode and the second electrode located close to the front substrate in the thickness direction of the front substrate, is approximately equal in thickness to the dielectric layer interposed between the discharge space and the electrode projections of the other electrode of the first electrode and the second electrode located at a distance from the front substrate.

3. A two-electrode-structure plasma display panel according to claim 1, wherein each of the first electrode projections of the first electrode comprises a transparent electrode in island form projecting in one direction from a mid-point of each portion of the first electrode body of the first electrode corresponding to an area between the two second electrode bodies of the second electrodes adjacent to each other, and each of the second electrode projections of the second electrode comprises a transparent electrode in island form facing the first electrode projection of the first electrode at a required interval when viewed from the front substrate, and each of the transparent electrodes of the second electrode is connected to the second electrode body through an electrode coupling portion.

4. A two-electrode-structure plasma display panel according to claim 3, wherein each of the transparent electrodes of the first electrode and the second electrode is formed in an approximate T shape, and widened head portions of the T shape of the transparent electrodes of the first electrode and the second electrode paired with each other face each other at the required interval when viewed from the front substrate.

5. A two-electrode-structure plasma display panel according to claim 3, wherein the electrode coupling portion of the second electrode comprises at least one of a black-colored metal layer and a dark-colored metal layer.

6. A two-electrode-structure plasma display panel according to claim 3, wherein the electrode coupling portion of the second electrode extends approximately parallel to the first electrode body of the first electrode, further comprising:

a light absorption layer of one of black and dark colors extending in the row direction between each row of the electrode coupling portions of the second electrodes and each of the first electrode bodies of the first electrodes when viewed from the front substrate.

7. A two-electrode-structure plasma display panel according to claim 1, wherein the first electrode body of the first electrode comprises at least one of a black-colored metal layer and a dark-colored metal layer.

8. A two-electrode-structure plasma display panel according to claim 1, wherein the second electrode body of the second electrode comprises at least one of a black-colored metal layer and a dark-colored metal layer.

9. A two-electrode-structure plasma display panel according to claim 1, further comprising a partition wall provided on a face of the back substrate facing toward the front substrate for partitioning the discharge space into unit light-emission areas each facing the first electrode projection of the first electrode and the second electrode projection of the second electrode, the first electrode projections and the second electrode projections being paired with each other.

10. A two-electrode-structure plasma display panel according to claim 9, wherein the partition wall comprises lateral walls extending in the row direction opposite the first electrode body of the first electrode.

11. A two-electrode-structure plasma display panel according to claim 10, further comprising additional dielectric layers each projecting from a portion of a rear-facing face of the dielectric layer opposing the first electric bodies of the first electrodes toward the discharge space to block off the unit light-emission areas, which are adjacent to each other in the column direction on both sides of the lateral wall of the partition wall, from each other.

12. A two-electrode-structure plasma display panel according to claim 11, further comprising a communicating member provided in a portion of the additional dielectric layer and of the lateral wall of the partition wall blocking the unit light-emission areas adjacent to each other in the column direction from each other, for establishing a partial communication between the unit light-emission areas adjacent to each other in the column direction.

13. A two-electrode-structure plasma display panel according to claim 12, wherein the communicating member comprises a groove formed in a portion of the additional dielectric layer blocking off the unit light-emission areas adjacent to each other in the column direction from each other.

14. A two-electrode-structure plasma display panel according to claim 9, wherein the partition wall comprises vertical walls extending in the column direction opposite the second electrode body of the second electrode.

15. A two-electrode-structure plasma display panel according to claim 14, further comprising additional dielectric layers projecting from a portion of a rear-facing face of the dielectric layer opposing the second electric body of the second electrode toward the discharge space to block off the unit light-emission areas, which are adjacent to each other in the row direction on both sides of the vertical wall of the partition wall, from each other.

16. A two-electrode-structure plasma display panel according to claim 9, wherein the partition wall is formed approximately in a grid shape comprising lateral walls extending in the row direction opposite the first electrode body of the first electrodes and vertical walls each extending in the column direction opposite the second electrode body of the second electrodes.

17. A two-electrode-structure plasma display panel according to claim 1, wherein the second electrode comprises electrode coupling portions each extending approximately parallel to the first electrode body of the first electrode, further comprising:

light absorption layers of one of black and dark colors each extending in the row direction between a row of the electrode coupling portions of the second electrodes and the first electrode body of the first electrode when viewed from the front substrate; and a partition wall provided on a face of the back substrate facing toward the front substrate for partitioning the discharge space into unit light-emission areas each facing the first electrode projection of the first electrode and the second electrode projection of the second electrode paired with each other, and comprising lateral walls each extending in the row direction opposite the first electrode body of the first electrode, the electrode coupling portions of the second electrode and the light absorption layer.

18. A two-electrode-structure plasma display panel, comprising:

a front substrate and a back substrate facing each other with a discharge space in between;

a dielectric layer formed on a face of the front substrate facing toward the back substrate;

a plurality of first electrodes arranged regularly in a column direction in the dielectric layer, and having a first electrode body extending in a row direction and first electrode projections projecting from the first electrode body;

a plurality of second electrodes arranged regularly in the row direction in the dielectric layer in a different plane from that in which the plurality of first electrodes are formed, in a thickness direction of the front substrate, and having a second electrode body extending in the column direction and second electrode projections projecting from the second electrode body, the second electrode projections facing the first electrode projection at a required interval when viewed from the front substrate; and recesses formed individually in portions of the dielectric layer facing the discharge space and covering at least the electrode projections of one electrode of the first electrodes and the second electrodes located close to the front substrate in the thickness direction of the front substrate.

* * * * *